US005949185A

United States Patent [19]

Janning

[11] Patent Number: 5,949,185

[45] Date of Patent: Sep. 7, 1999

[54] FIELD EMISSION DISPLAY DEVICES

[75] Inventor: John L. Janning, Dayton, Ohio

[73] Assignee: St. Clair Intellectual Property Consultants, Inc., Grosse Pointe, Mich.

[21] Appl. No.: 09/086,135

[22] Filed: May 28, 1998

Related U.S. Application Data

[63] Continuation-in-part of application No. 08/955,880, Oct. 22, 1997.

[51] Int. Cl.[6] ..... H01J 29/46

[52] U.S. Cl. ..... 313/495; 313/103 CM; 313/105 CM

[58] Field of Search ..... 313/495, 336, 313/309, 351, 103 CM, 105 CM, 103 R, 104

[56] References Cited

U.S. PATENT DOCUMENTS 4,857,161 8/1989 Borel et al. .

5,229,331 7/1993 Doan et al. .

5,378,963 1/1995 Ikeda ..... 313/336 X 5,384,509 1/1995 Kane et al. .

5,473,218 12/1995 Moyer .

5,473,219 12/1995 Ikeda ..... 313/495 X 5,656,887 8/1997 Voshell et al. ..... 313/496

*Primary Examiner*—Sandra O'Shea

*Attorney, Agent, or Firm*—Harness, Dickey & Pierce, P.L.C.

[57] ABSTRACT

A cathodoluminescent field emission display devices features an enhancement layer disposed over an outer surface of a substantially planar cathode electron emitter of the device. The enhancement layer provides enhanced secondary electron emissions. The enhancement layer is preferably near mono-molecular film of an oxide of barium, beryllium, calcium, magnesium, strontium or aluminum.

10 Claims, 1 Drawing Sheet

FIELD EMISSION DISPLAY DEVICES

This application is a continuation-in-part of U.S. application Ser. No. 08/955,880 filed Oct, 22, 1997.

This invention relates to electronic field emission display devices, such as matrix-addressed monochrome and full color flat panel displays in which light is produced by using cold-cathode electron field emissions to excite cathodoluminescent material. Such devices use electric fields to induce electron emissions, as opposed to elevated temperatures or thermionic cathodes as used in cathode ray tubes.

BACKGROUND OF THE INVENTION

Cathode ray tube (CRT) designs have been the predominant display technology, to date, for purposes such as home television and desktop computing applications. CRTs have drawbacks such as excessive bulk and weight, fragility, power and voltage requirements, electromagnetic emissions, the need for implosion and X-ray protection, analog device characteristics, and an unsupported vacuum envelope that limits screen size. However, for many applications, including the two just mentioned, CRTs have present advantages in terms of superior color resolution, contrast and brightness, wide viewing angles, fast response times, and low cost of manufacturing.

To address the inherent drawbacks of CRTs, such as lack of portability, alternative flat panel display design technologies have been developed. These include liquid crystal displays (LCDs), both passive and active matrix, electroluminescent displays (ELDs), plasma display panels (PDPs), and vacuum fluorescent displays (VFDs). While such flat panel displays have inherently superior packaging, the CRT still has optical characteristics that are superior to most observers. Each of these flat panel display technologies has its unique set of advantages and disadvantages, as will be briefly described.

The passive matrix liquid crystal display (PM-LCD) was one of the first commercially viable flat panel technologies, and is characterized by a low manufacturing cost and good x-y addressability. Essentially, the PM-LCD is a spatially addressable light filter that selectively polarizes light to provide a viewable image. The light source may be reflected ambient light, which results in low brightness and poor color control, or back lighting can be used, resulting in higher manufacturing costs, added bulk, and higher power consumption. PM-LCDs generally have comparatively slow response times, narrow viewing angles, a restricted dynamic range for color and gray scales, and sensitivity to pressure and ambient temperatures. Another issue is operating efficiency, given that at least half of the source light is generally lost in the basic polarization process, even before any filtering takes place. When back lighting is provided, the display continuously uses power at the maximum rate while the display is on.

Active matrix liquid crystal displays (AM-LCDs) are currently the technology of choice for portable computing applications. AM-LCDs are characterized by having one or more transistors at each of the display's pixel locations to increase the dynamic range of color and gray scales at each addressable point, and to provide for faster response times and refresh rates. Otherwise, AM-LCDs generally have the same disadvantages as PM-LCDs. In addition, if any AM-LCD transistors fail, the associated display pixels become inoperative. Particularly in the case of larger high resolution AM-LCDs, yield problems contribute to a very high manufacturing cost.

AM-LCDs are currently in widespread use in laptop computers and camcorder and camera displays, not because of superior technology, but because alternative low cost, efficient and bright flat panel displays are not yet available. The back lighted color AM-LCD is only about 3 to 5% efficient. The real niche for LCDs lies in watches, calculators and reflective displays. It is by no means a low cost and efficient display when it comes to high brightness full color applications.

Electroluminescent displays (ELDs) differ from LCDs in that they are not light filters. Instead, they create light from the excitation of phosphor dots using an electric field typically provided in the form of an applied AC voltage. An ELD generally consists of a thin-film electroluminescent phosphor layer sandwiched between transparent dielectric layers and a matrix of row and column electrodes on a glass substrate. The voltage is applied across an addressed phosphor dot until the phosphor "breaks down" electrically and becomes conductive. The resulting "hot" electrons resulting from this breakdown current excite the phosphor into emitting light.

ELDs are well suited for military applications since they generally provide good brightness and contrast, a very wide viewing angle, and a low sensitivity to shock and ambient temperature variations. Drawbacks are that ELDs are highly capacitive, which limits response times and refresh rates, and that obtaining a high dynamic range in brightness and gray scales is fundamentally difficult. ELDs are also not very efficient, particularly in the blue light region, which requires rather high energy "hot" electrons for light emissions. In an ELD, electron energies can be controlled only by controlling the current that flows after the phosphor is excited. A full color ELD having adequate brightness would require a tailoring of electron energy distributions to match the different phosphor excitation states that exist, which is a concept that remains to be demonstrated.

Plasma display panels (PDPs) create light through the excitation of a gaseous medium such as neon sandwiched between two plates patterned with conductors for x-y addressability. As with ELDs, the only way to control excitation energies is by controlling the current that flows after the excitation medium breakdown. DC as well as AC voltages can be used to drive the displays, although AC driven PDPs exhibit better properties. The emitted light can be viewed directly, as is the case with the red-orange PDP family. If significant UV is emitted, it can be used to excite phosphors for a full color display in which a phosphor pattern is applied to the surface of one of the encapsulating plates. Because there is nothing to upwardly limit the size of a PDP, the technology is seen as promising for large screen television or HDTV applications. Drawbacks are that the minimum pixel size is limited in a PDP, given the minimum volume requirement of gas needed for sufficient brightness, and that the spatial resolution is limited based on the pixels being three-dimensional and their light output being omnidirectional. A limited dynamic range and "cross talk" between neighboring pixels are associated issues.

Vacuum fluorescent displays (VFDs), like CRTs, use cathodoluminescence, vacuum phosphors, and thermionic cathodes. Unlike CRTs, to emit electrons a VFD cathode comprises a series of hot wires, in effect a virtual large area cathode, as opposed to the single electron gun used in a CRT. Emitted electrons can be accelerated through, or repelled from, a series of x and y addressable grids stacked one on top of the other to create a three dimensional addressing scheme. Character-based VFDs are very inexpensive and widely used in radios, microwave ovens, and automotive dashboard instrumentation. These displays typically use low voltage ZnO phosphors that have significant output and acceptable efficiency using 10 volt excitation.

A drawback to such VFDs is that low voltage phosphors are under development but do not currently exist to provide the spectrum required for a full color display. The color vacuum phosphors developed for the high-voltage CRT market are sulfur based. When electrons strike these sulfur based phosphors, a small quantity of the phosphor decomposes, shortening the phosphor lifetimes and creating sulfur bearing gases that can poison the thermionic cathodes used in a VFD. Further, the VFD thermionic cathodes generally have emission current densities that are not sufficient for use in high brightness flat panel displays with high voltage phosphors. Another and more general drawback is that the entire electron source must be left on all the time while the display is activated, resulting in low power efficiencies particularly in large area VFDs.

Against this background, field emission displays (FEDs) potentially offer great promise as an alternative flat panel technology, with advantages which would include low cost of manufacturing as well as the superior optical characteristics generally associated with the traditional CRT technology. Like CRTs, FEDs are phosphor based and rely on cathodoluminescence as a principle of operation. High voltage sulfur based phosphors can be used, as well as low voltage phosphors when they become available.

Unlike CRTs, FEDs rely on electric field or voltage induced, rather than temperature induced, emissions to excite the phosphors by electron bombardment. To produce these emissions, FEDs have generally used a multiplicity of x-y addressable cold cathode emitters. There are a variety of designs such as point emitters (also called cone, microtip or "Spindt" emitters), wedge emitters, thin film amorphic diamond emitters or thin film edge emitters, in which requisite electric fields can be achieved at lower voltage levels.

Each FED emitter is typically a miniature electron gun of micron dimensions. When a sufficient voltage is applied between the emitter tip or edge and an adjacent gate, electrons are emitted from the emitter. The emitters are biased as cathodes within the device and emitted electrons are then accelerated to bombard a phosphor generally applied to an anode surface. Generally, the anode is a transparent electrically conductive layer such as indium tin oxide (ITO) applied to the inside surface of a faceplate, as in a CRT, although other designs have been reported. For example, phosphors have been applied to an insulative substrate adjacent the gate electrodes which form apertures encircling microtip emitter points. Emitted electrons move upwardly through the apertures and strike phosphor areas.

FEDs are generally energy efficient since they are electrostatic devices that require no heat or energy when they are off. When they operate, nearly all of the emitted electron energy is dissipated on phosphor bombardment and the creation of emitted unfiltered visible light. Both the number of exciting electrons (the current) and the exciting electron energy (the voltage) can be independently adjusted for maximum power and light output efficiency. FEDs have the further advantage of a highly nonlinear current-voltage field emission characteristic, which permits direct x-y addressability without the need of a transistor at each pixel. Also, each pixel can be operated by its own array of FED emitters activated in parallel to minimize electronic noise and provide redundancy, so that if one emitter fails the pixel still operates satisfactorily. Another advantage of FED structures is their inherently low emitter capacitance, allowing for fast response times and refresh rates. Field emitter arrays are in effect, instantaneous response, high spatial resolution, x-y addressable, area-distributed electron sources unlike those in other flat panel display designs.

Due to the inherent problems, notably the expense of manufacture, associated with microtip or "Spindt" type emitters, recent developments in the area of FEDs have focused on flat surface emitters. In particular, much work is being done in the area of flat film diamond electron emitters for FEDs because of its low electron affinity and high temperature properties. See, e.g., U.S. Pat. Nos. 5,449,970; 5,543,684; and 5,686,791. Furthermore, some work is being done in the areas of surface conduction electron emitters and radioactive emitter. See, e.g., U.S. Pat. No. 5,023,110 and pending parent application U.S. Ser. No. 08/955,880 filed Oct. 22, 1997, respectively.

While extensive research and development has been devoted to FEDs in recent years, and yet problems remain unsolved. It was against this background that the present invention has been conceived.

OBJECTS OF THE INVENTION

It is accordingly an object of this invention to provide a low cost, high efficiency field emission display having the superior optical characteristics generally associated with the traditional CRT technology, in the form of a digital device with flat panel packaging.

Another object of the invention is to provide a field emission display device, for either monochrome or full color applications, with improved light conversion efficiencies, and with greater cathode to anode voltage level flexibility.

Another object of the invention is to increase the efficiency of electron emissions within a field emission display device.

SUMMARY OF THE INVENTION

To achieve enhanced secondary electron emissions within a FED device, an amplification enhancement layer is applied over an outer surface of a substantially planar cathode electron emitter of an otherwise conventional flat film FED. Preferably, the enhancement layer will be near monomolecular in thickness and be comprised of an oxide of barium, beryllium, calcium, magnesium, strontium or aluminum.

The objects, features and advantages of the invention will become apparent from the further descriptions and the attached drawings.

DETAILED DESCRIPTION OF THE PRESENTLY PREFERRED EMBODIMENTS

Figure 1:
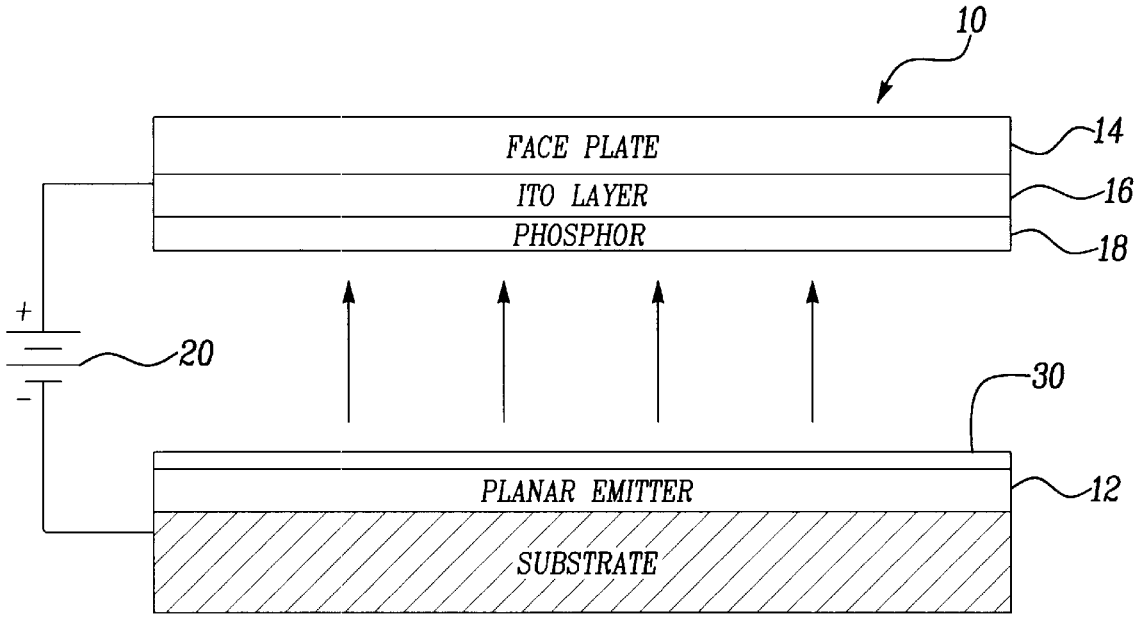
FIG. 1 is a cross sectional schematic view of an exemplary field emission display device implementing a flat film emitter in accordance with the principles of the present invention.

FIG. 1 schematically depicts an exemplary field emission display (FED) device 10 having a cathode emitter 12 which uses cathodoluminescence of a light emitting layer 14 as a principle of operation. Generally, a field emitter cathode matrix may be opposed by a phosphor-coated, transparent faceplate 14 that serves as an anode and has a positive voltage relative to the emitter array matrix. The FED devices 10 incorporates a transparent conductive layer 16 such as indium tin oxide (ITO), applied to the inside surface of the faceplate 14 or between the faceplate 14 and a phosphor coating 18, to provide the anode electrode applicable biasing with respect to the cathode-emitters. The conductive layer 16 and the phosphor coating 18 may be masked or patterned on the faceplate to provide a matrix of x-y addressable pixels, with addressing provided via a selective cathode-emitter activation.

Cathode emitter 12 is a flat or substantially planar structure that is formed on a substrate material. Although diamond electron emitters are presently preferred, this is not intended as a limitation on the broader aspects of this invention. On the contrary, an enhancement layer 30 of the present invention may be suitably used with various types of substantially planar cathode emitters. It is also envisioned that the cathode emitter may be activated in accordance with different operating principles (e.g., surface conduction emitters).

When the FED 10 is operational, a group of emitters 12 is addressed and activated by application of a gate potential 20 between the faceplate 14 and cathode emitter 12. With the resulting primary field emission of electrons from the emitters 12, the emitted electrons are accelerated toward the anode conductor layer 16 to bombard the intervening phosphors 18. The phosphors 18 are induced into cathodoluminescence by the bombarding electrons, emitting light through the faceplate 14 for observation by a viewer. The operational potential between the conductive layer 16 and the cathode emitter 12 is generally on the order of 500 to 1000 volts for FEDs using high-voltage, sulfur-based phosphors. As will be apparent to one skilled in the art, different addressing and activation schemes may be employed depending on the particular configuration of the FED device.

This invention modifies a conventional flat surface cathode emitter by incorporating an enhancement layer 30 of near mono-molecular thickness (e.g. 10 to 15 Angstroms) over at least selected portions of an outer surface of the cathode emitter 12. Layer 30 comprises a high secondary electron emission material such as oxide of barium, beryllium, calcium, magnesium, strontium or aluminum. Oxides of magnesium, beryllium and aluminum are believed to be particularly effective. Use of layer 30 enables improved display brightness levels and/or reduction in the number of cathode emitters required for acceptable operation of the FED display 10. Moreover, enhancement layer 30 increases secondary emissions of electrons within the device.

The amplification enhancement layer 30 may be deposited by conventional sputtering from a conditioned alloy target or, for example, by a co-sputtering process. To illustrate, a lightly oxidized beryllium target may be prepared by moving a target from room-temperature, ambient conditions to an oven at about 250° C. for about 30 minutes, converting the exposed beryllium surface to Be—O. The resulting lightly oxidized target can then be introduced along with a second, copper target for use within a sputtering chamber which is evacuated and back-filled with argon to a pressure of approximately one to ten microns. By sputtering initially from the beryllium target only, a near mono-molecular beryllium oxide layer may be deposited.

While the presently preferred embodiments of the invention have been illustrated and described, it will be understood that those and yet other embodiments may be within the scope of the following claims.

What is claimed is:

1. In a field emission display device including at least one substantially planar cathode electron emitter and a light emitting layer of cathodoluminescent material for bombardment by electrons resulting from operation of the cathode emitter, the improvement comprising:

an enhancement layer disposed on an outer surface of the planar cathode emitter for providing enhanced secondary emissions of electron within the device.

2. The device of claim 1 wherein the enhancement layer is near monomolecular in thickness.

3. The device of claim 2 wherein the enhancement layer is fashioned from material exhibiting high secondary electron emissions when bombarded by electrons.

4. The device of claim 2 wherein the enhancement layer is fashioned from material selected from the group comprising oxides of barium, beryllium, calcium, magnesium, strontium and aluminum.

5. The device of claim 1 wherein the enhancement layer has a thickness on the order of 10 Angstroms.

6. A cathodoluminescent field emission display device, which comprises:

a faceplate through which emitted light is transmitted from an inside surface to an outside surface of the faceplate for viewing;

a substantially planar cathode emitter for primary field emissions of electrons;

an enhancement layer disposed on an outer surface of the planar cathode emitter for providing enhanced secondary emissions of electron;

an anode, comprising a layer of electrically conductive material disposed between the inside surface of the faceplate and the cathode emitter; and a light emitter layer of cathodoluminescent material capable of emitting light through the faceplate in response to bombardment by electrons emitted within the device, disposed between the anode and the cathode emitter.

7. The device of claim 6 wherein the enhancement layer is near monomolecular in thickness.

8. The device of claim 7 wherein the enhancement layer is fashioned from material exhibiting high secondary electron emissions when bombarded by electrons.

9. The device of claim 7 wherein the enhancement layer is fashioned from material selected from the group comprising oxides of barium, beryllium, calcium, magnesium, strontium and aluminum.

10. The device of claim 6 wherein the enhancement layer has a thickness on the order of 10 Angstroms.

* * * * *